United States Patent [19]

Heise

[11] 3,938,785

[45] Feb. 17, 1976

[54] METHOD AND APPARATUS FOR MANUFACTURING A COATING MASS FOR ROAD CONSTRUCTIONS

[76] Inventor: Carl-Hermann Heise, Hannoversche Str. 61, 3220 Alfeld, Germany

[22] Filed: Feb. 18, 1975

[21] Appl. No.: 550,865

Related U.S. Application Data

[62] Division of Ser. No. 368,352, June 8, 1973, Pat. No. 3,880,410.

[30] Foreign Application Priority Data

June 10, 1972 Germany ..... 2228407

[52] U.S. Cl. ..... 259/149; 259/155; 259/159 R

[51] Int. Cl.[2] ..... B28C 1/22

[58] Field of Search ..... 259/148, 155, 154, 157, 259/158, 149, 159 R, 159 A, 165, 164, 161, 162, 146

[56] References Cited

UNITED STATES PATENTS

| | | | |
|---|---|---|---|
| 3,110,421 | 11/1963 | Matthias | 259/154 |
| 3,170,677 | 2/1965 | Phister | 259/154 |
| 3,353,798 | 11/1967 | Draper | 259/149 |
| 3,625,488 | 12/1971 | Farnham | 259/154 |
| 3,661,365 | 5/1972 | Cloud | 259/154 |

*Primary Examiner*—Robert W. Jenkins
*Attorney, Agent, or Firm*—Roland I. Griffin

[57] ABSTRACT

A method and apparatus for manufacturing a coating mass for road constructions are disclosed wherein stone minerals of different grain size ranges are dosed, dried, heated, dusted off and supplemented with a binding agent and other flux materials. The stone minerals of the various grain size ranges are separated from each other and are predosed, dried and heated. This divides the stone minerals of each grain size range into a stone fraction and a respectively absorbed fine grain size material which is divided into a sand fraction and a self filler fraction by means of filtering, the sand fraction is thereafter added again to the stone fraction of the respective grain size range, and the self filler fractions of all grain size ranges are combined weighted. All of the heated stone and sand fractions are also weighted and combined and are mixed together with the combined and weighted self filler fraction, and the binding agent in order to provide the coating mass.

5 Claims, 3 Drawing Figures

METHOD AND APPARATUS FOR MANUFACTURING A COATING MASS FOR ROAD CONSTRUCTIONS

This is a division of application Ser. No. 368,352, filed June 8, 1973 now U.S. Pat. No. 3,880,410.

BACKGROUND OF THE INVENTION

In the known methods for manufacturing coating masses for road constructions the different grain sizes which are required for manufacturing the required grain mixture of each coating mass are predosed by dosing means and are then commonly subjected to a drying operation. The drying is effected in a known drying drum, which can be operated in a one-direction current mode or a counter-current mode and which comprises an energy source in the form of an oil or gas burner. During this drying operation, a fine grain size fraction is taken off together with the heating gases, which form the heat carrier supplied to the material to be dried. The fine grain size fraction is reobtained in a one-stage or multi-stage filtering means.

The fine grain size fraction taken off together with the heating gases has a relatively heterogeneous grain composition. The grain size stepping depends on several factors, such as the initial humidity, the velocity of the air in the drying drum, the specific weight, the shape of the insertions, the heating medium used, and the like. Also, during the drying operation the grain size composition of the fine grain size fraction entrained by the heating gases varies, especially because of power variations and because of the different grain composition for different prescriptions.

In the known methods for manufacturing coating masses for road constructions, the stone minerals mixed from different grain size ranges are also screened in their hot condition after the drying operation and before being mixed with bitumen. This is necessary in order to assure a highly homogeneous mixture of the stone minerals. The screen apertures and surfaces required for the screening operation are especially remarkable in the grain size range from 0 – 2 mm. Thus, in most cases greater screen apertures are used in order to decrease the screen surfaces and to be able to screen a greater volume per screen surface unit. However, this has the disadvantage that stone fractions in the lower grain size ranges are rather inaccurate. On the other hand, these stone fractions substantially determine the cavity fraction of the finished coating mass. The cavity fraction of a coating, in turn, is significant because of a number of essential qualities such as the rigidness of the bitumen binding, the bitumen fraction, and the compression strength of the coating mass. Known manufacturing methods have the further disadvantage that the period of dwell of the individual grain size fractions in the drying drum varies markedly. In the counter-current mode the fine grain size fraction remains in the drying drum for a relatively long time as it is obtained from the heating gases in certain grain size ranges. However, in the one-direction mode the fine grain size fraction is especially accelerated by the heating gases.

Another essential disadvantage of known manufacturing methods is based on the fact that the fine grain fractions taken off together with the heating gases can to a great extent be considered as a fraction of the grain size range of 0 – 3 mm and only to a smaller extent as a self filler fraction in the grain size range of 0.09 – 0.3 mm. Thus, it becomes obvious that for a given prescription the fractions of smaller grain size ranges are especially difficult to control. However, the essential characteristics of the road coating mass are determined by these fractions.

SUMMARY OF THE INVENTION

Thus, it is the object of this invention to overcome the shortcomings of the prior art and to provide a method and an apparatus that make it possible to follow more accurately the prescription as to the grain size ranges of the stone minerals than was possible before. It is especially essential that the fractions of the smaller grain size ranges be controlled more accurately.

This object is achieved according to the present invention by providing a method for manufacturing a coating mass for road constructions wherein stone minerals of different grain size ranges are dosed, dried, heated, dusted off, and supplemented by a binding agent and other flux materials. This method is characterized in that the stone minerals of the different grain size ranges are separately predosed, dried, and heated and in that the respectively absorbed fine material thereby respectively separated from a stone fraction of each respective individual grain size range is divided into a sand fraction and a self filler fraction, after which the sand fraction is again added to the stone fraction of the respective individual grain size range from which it was separated and the self filler fractions of all grain size ranges are combined and weighted. The heated stone and sand fractions are weighted and mixed together with the combined and weighted self filler fractions and the binding agent in order to form the coating mass.

In accordance with the present invention, each grain size range may be treated individually for a sufficient amount of time. For example, material in the grain size range of 0 – 2 mm, which is separately supplied to the construction site, is predosed and supplied to a separate drying means. In this drying means the material is separated into the stone fraction passing the drying means and into the absorbed fine material. The absorbed fine material already has a substantially closer grain size range than the fine grain size fraction that is supplied with the conventional drying means. However, the absorbed fine material can be separated into a sand fraction and into a self filler fraction. The sand fraction will, for example, include particles in the grain size range of about 0.3 – 0.8 mm. Concomitantly the self filler fraction will include particles in the grain size range of about 0.09 – 0.3 mm. The sand fraction and the stone fraction are re-united, while the self filler fraction is taken off separately and is combined with the self filler fractions of the remaining grain size ranges. By this individual treatment separate dried and heated stone fractions of the individual grain size ranges are obtained free from the self filler fraction. With these heated stone fractions it is possible to follow prescriptions more accurately than was possible before. If desired, strange filler fractions can be added to the combined self filler fraction. The heated stone fractions of the individual grain size ranges are preferably weighted charge-wise and combined. However the sand fractions of the absorbed fine materials are added to the stone fractions of the corresponding grain size ranges. This can be done by adding each sand fraction to the stone fraction from which it is derived, or by adding each sand fraction to another suitable stone fraction.

The separation of the absorbed fine material into sand and self filler fractions is done in several filter stages. Thus, it is possible to form only one sand fraction and one self filler fraction. However, it is also possible to separate several sand fractions and one self filler fraction.

The apparatus for performing this method includes a mixing container for mixing the stone and sand fractions, the self filler fraction and the binding agent and is characterized in that for the stone minerals of each individual grain size range preparing means is provided for predosing, drying, and the stone minerals to separate absorbed fine material from a stone fraction of the stone minerals and for and separating the absorbed fine material into a sand fraction and a self filler fraction. In addition, there is provided a conveyor means for combining all self filler fractions. Each preparing means for the treatment of the individual grain size ranges includes a drying drum, a filter means, and a heating silo with a scale and a take-off means. The filter means can be a multi-stage means having a pre-separator for the sand fraction and a conveyor located for conveying the sand fraction separated from the fine material. In addition the filter means has a main separator for the self filler fraction and a conveyor located for conveying the self filler fraction separated from the stone fraction and the sand fraction.

On the side of the material inlet each drying drum has a hollow inlet screw with a preceding dosing means, the filter means for taking off the absorbed fine material and the heating gases being connected by a channel to this hollow inlet screw. The preseparator of the filter means can have an enlarged cross section relative to this channel in order to decelerate the stream of absorbed fine material and to separate the sand fraction therefrom. Preferably, each drying drum is constructed to also serve as a conveyor means for the respective sand fraction separated from the fine material. On its outer circumference each drying drum has an outlet screw with a corresponding housing to provide such conveyor means. In order to combine the stone fractions and the sand fractions this conveyor means and the interior of each drying drum are connected to a respective heating bucket conveyor and heating silo.

Several dosing means can precede the hollow inlet screw of the drying drum so that, for example, stone minerals of the same grain size ranges but of different origin can be prepared together. The heating silo includes a sample take-off stub with a test screen having an electro-mechanical drive means. A portion of the dried stone and sand fraction can be taken off by means of this take-off stub and can be fed to a lower test screen in order to control the grain size of the stone and sand fractions in the dried condition. After the weight of the oversize fraction and or the undersize fraction has been determined the preceding and the subsequent grain size can immediately be corrected in accordance with the total prescription.

The described method and apparatus have several advantages. One of these advantages is that the feed back of the sand fraction pre-separated from the fine material reduces the self filler fraction and simultaneously limits its grain size range. Another is that the feed back of each sand fraction to the outer circumference of the respective drying drum improves the efficiency of the heat exploitation. Still another is that the hollow inlet screw at the inlet of each drying drum assures that the stone minerals are introduced into each drying drum in an air tight manner such that no infiltrating air can enter into the apparatus that would increase the exhaust gas quantity and decrease the drying temperature. The absorption channel connected to the hollow inlet screw at the inlet of each drying drum is also sealed against the entry of infiltrating air. This leads to smaller exhaust gas quantities and smaller filter surfaces. The outlet of each drying drum can simply be constructed to serve simultaneously as a drive for the heating bucket conveyor. Thus, the stone fraction and the sand fraction can be re-united in a simple manner. The undisturbed heat gas conduction and the exclusion of the entry of infiltrating air favor a maximum drying effect by radiation and convection and thus a maximum fraction of the fine material. In principle, the stone fractions of the individual grain size ranges are thereby made cleaner.

The apparatus allows a quick change of the prescription without the need of operating on preceding stone quantities which are in the preparation process. The control capability of each individual fraction in the range of the heating silo makes it possible to correct the composition of the mixture at any time during the preparation process. During the entire operation there will be no grain overflow, as always only a single fraction is absorbed from each heating silo. The burner means of each drying drum can be adjusted to the respective grain size range. Thus, the drying process is accommodated to the individual materials. Each individual drying drum can also be used as a filler drying apparatus with direct heating.

BRIEF DESCRIPTION OF THE DRAWINGS

The present invention is illustrated below with the aid of the accompanying drawings wherein.

DESCRIPTION OF THE PREFERRED EMBODIMENT

Figure 1:
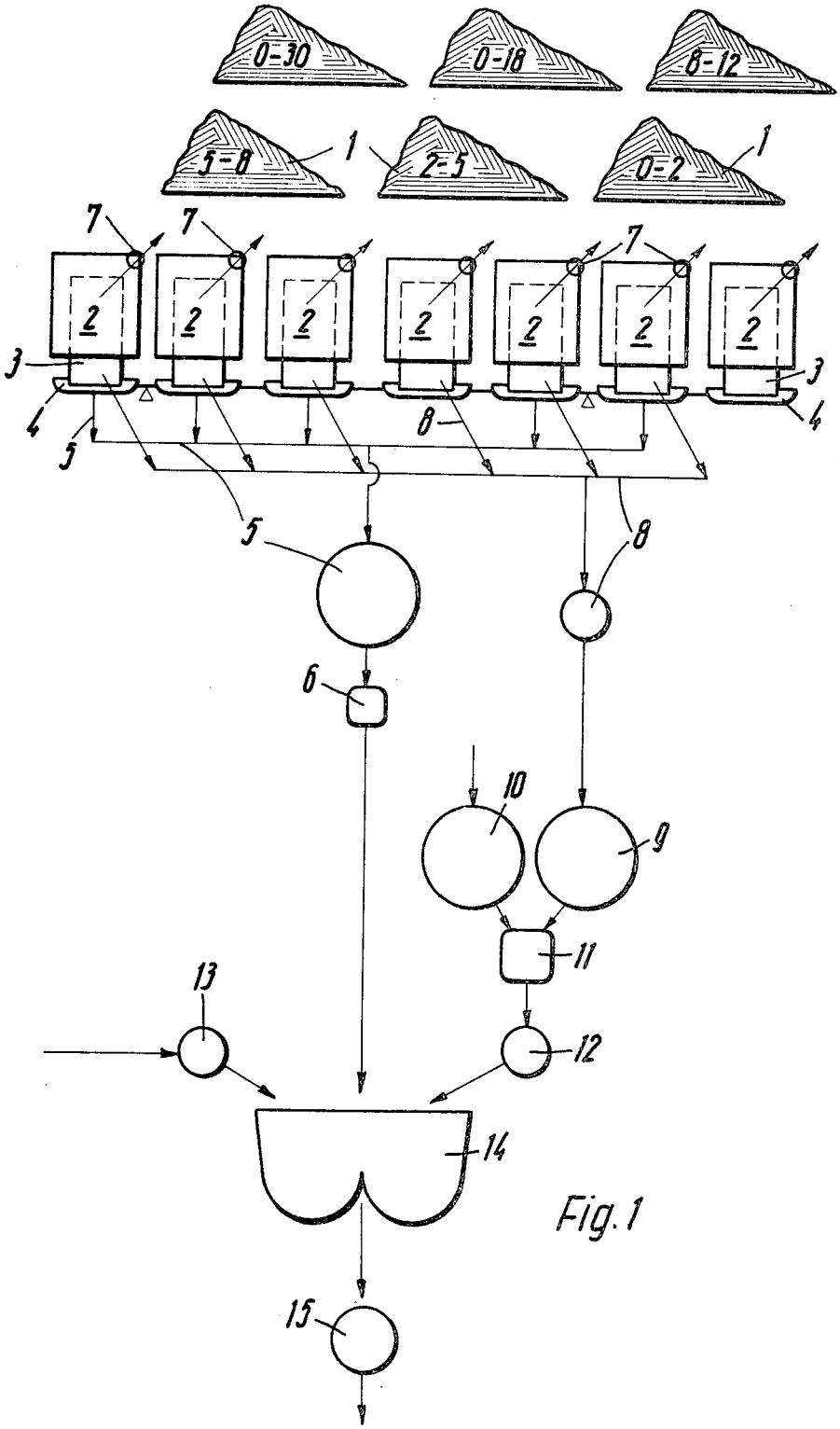
FIG. 1 is a flow and schematic diagram according to the preferred embodiment of the method and apparatus of this invention.

During the manufacturing process of a coating mass for road constructions, stone minerals of different grain size ranges are supplied seaprately at the construction site. In FIG. 1 this is schematically indicated by the stone minerals 1 which are designated by the corresponding grain size ranges. Each stone mineral 1 of a certain grain size range is prepared by a separate means 2. All means 2 for preparing the stone minerals are substantially equal or similar. Each serves to pre-dose, dry, and heat the stone minerals of a respective grain size range and to thereby separate them into a stone fraction and into absorbed fine material comprising a sand fraction and a self filler fraction. A heating silo 3 with a scale 4 is located at the end of each preparing means 2. The stone fraction of the respective grain size range is taken from the heating silo 3 via a scale 4 and, as is explained later, the sand fraction will be added to it. The stone and sand fractions of the different grain size ranges, but not the self filler fractions, are combined via a conveyor means 5 and are stored chargewise in a container 6.

Each preparing means 2 has a filter means 7, which, apart from other purposes, serves to separate the self filler fraction from the stone fraction and the sand fraction such that the self filler fraction can be taken off separately from the stone and sand fractions via a conveyor means 8. The self filler fraction is supplied to a silo 9. Another silo 10 is provided for a strange filler fraction. The self filler fraction is taken off from the silo 9 and/or the strange filler fraction is taken off from the silo 10 via a filler scale 11. This filler fraction is supplied to a filler container 12.

The stone and sand fractions, the filler fractions, and the bitumen, as well as eventually further flux materials, are supplied from the container 6, the filler container 12, and a bitumen container 13 into a mixing container 14 and from there to a storage container 15 or to a transport station. The material in the storage container 15 is already the coating mass.

It is essential that each stone mineral 1 of the respective grain size range be prepared separately from the stone minerals 1 of the remaining grain size ranges. During this preparation process, each stone mineral 1 is pre-dosed, dried, and in the preparing means 2 heated and thereby divided into the stone fraction and into the fine material. The fine material is divided into the sand fraction and into the self filler fraction with the aid of the filter means 7, and the sand fraction is again added to the stone fraction. Both the stone and the sand fractions are supplied to the respective heating silo 3. The self filler fraction is separately taken off from each filter means 7 and combined with the other self filler fractions.

Figure 2:
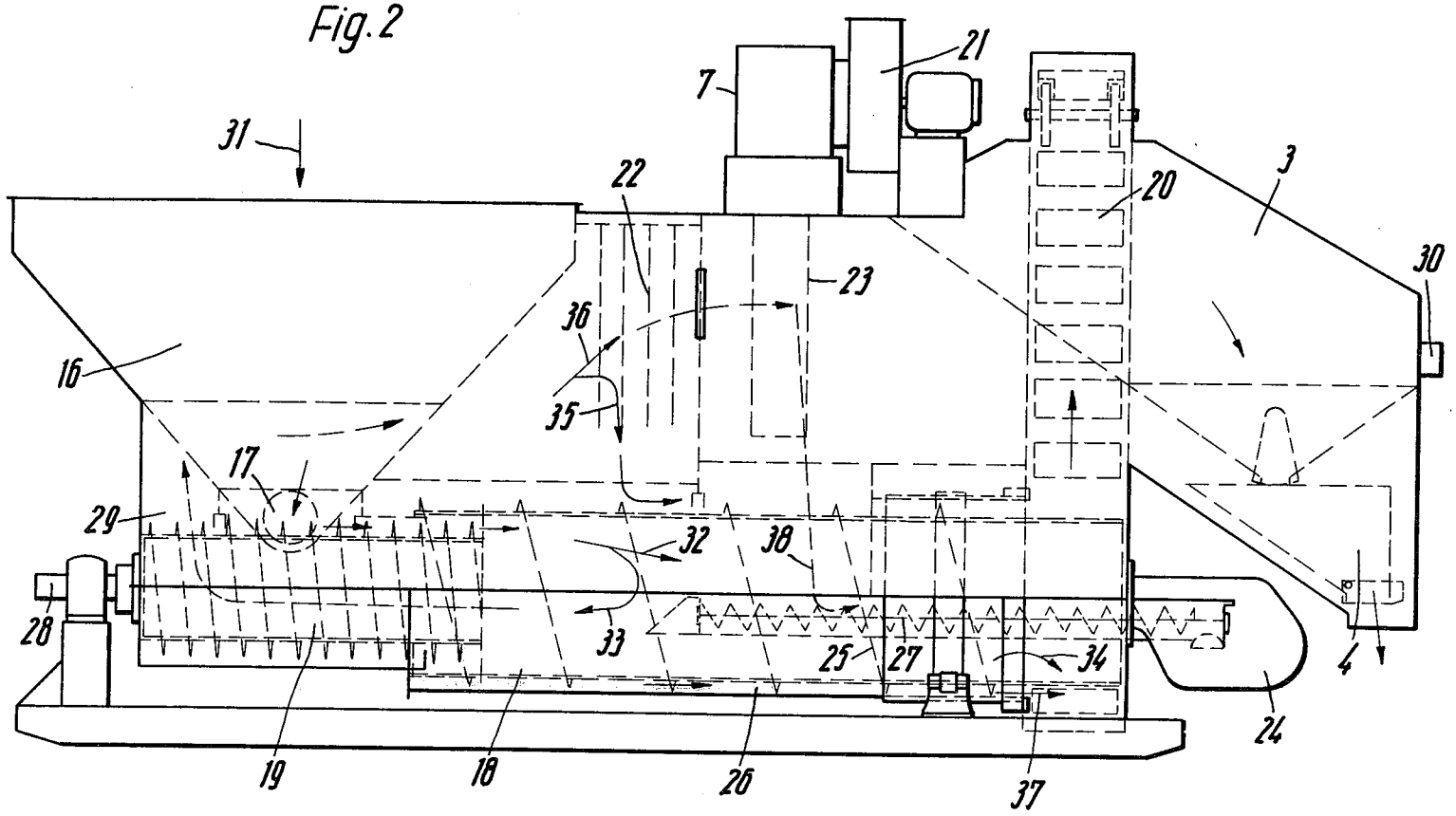
FIG. 2 is a schematic, longitudinal-sectional view of a single section of an apparatus according to the preferred embodiment of this invention.
Figure 3:
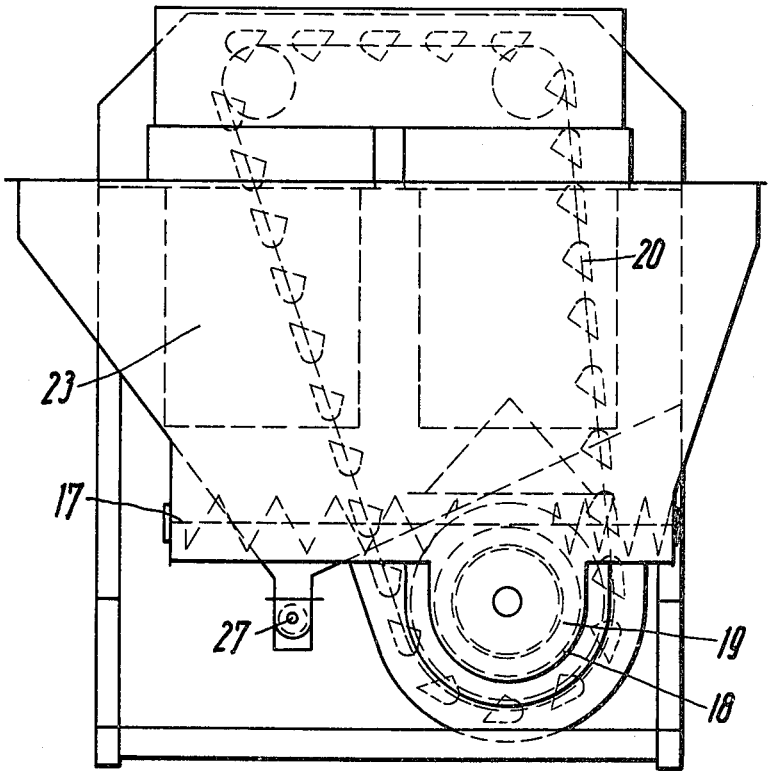
FIG. 3 is a schematic or is, cross-sectional view of the same section of the apparatus shown in FIG. 2.

In FIGS. 2 and 3 a single preparing means 2 is illustrated. It consists substantially of a dosing means 16 with a dosing screw 17, a drying drum 18 with a hollow inlet screw 19, a heating bucket conveyor 20, a heating silo 3, and a scale 4. Furthermore, each preparing means 2 has a filter means 7 with a blower 21, a pre-separator 22, and a main separator 23. The drying drum 18 has a known burner 24. Furthermore, on its outer circumference it is constructed to serve as a conveyor means. For this purpose it is provided with a screw 25. There is provided a housing 26, which cooperates with the screw 25. Each preparing means 2 also has a filler return screw 27, which is part of the conveyor means 8 of FIG. 1. The hollow inlet screw 19 and, the drying drum 18, and preferably the heating bucket conveyor 20 are supplied with drive power via a single drive means 28. The filter means 7 has a channel 29, which is connected to the hollow inlet screw 19. A sample take-off stud 30 is located in the area of the heating silo 3.

The respective stone minerals 1 on the respective grain size range, for example, 0 2 mm, are fed into the dosing means 16 according to the arrow 31. From the dosing means 16 the stone minerals 1 of this grain size range are supplied to the hollow inlet screw 19 by means of the dosing screw 17. The hollow inlet screw 19 introduces the material into the drying drum 18 in an air tight manner. Thus, the stone minerals 1 of the respective grain size range are introduced into the drying drum 18 in dosed form. The burner 24 provides the drying and heating of these stone minerals 1. In the illustrated embodiment, the drying drum 18 is operated in the counter-current mode. Within the drying drum 18 the stone minerals 1 of the respective grain size range are divided into the stone fraction, as indicated by the arrow 32, and into the fine material absorbed together with the heating gases, as indicated by the arrow 33. The stone fraction travels through the drying drum 18 in a direction opposite from that of the heating gases. At the end of the drying drum 18 it is guided to the heating bucket cnveyor 20 in the direction of the arrow 34. As indicated by the arrow 33, the stream of heating gases and the fine material absorbed together therewith pass through the hollow inlet screw 19 and the channel 29 by which they are guided to the pre-separator 22, which has an extended cross section relative to the channel 29 such that the stream is substantially decelerated. This divides the fine material into a sand fraction, as indicated by the arrow 35, and a self filler fraction as indicated by the arrow 36. The sand fraction falls from the pre-separator 22 onto a suitable conveyor means or directly onto the outer circumference of the drying drum 18 where the screws 25 is located. Thus the sand fraction is transported on the outer circumference of the drying drum 18 towards the heating bucket conveyor 20 and is introduced into the heating bucket conveyor 20, as is the case with the stone fraction passing through the drying drum 18. Although the fine material has already been heated in the drying drum, a further heating of the sand fraction at the outer circumference of the drying drum takes place thereby improving the efficiency of the heat transfer. The stone fraction and the sand fraction are supplied to the heating silo 3 via the heating bucket conveyor 20. From there they are taken off charge-wise by means of the scale 4. The grain size range of the stone and sand fractions can be examined at all times by means of the take off stud 30. In the illustrated embodiment with the grain size range of 0 – 2 mm, the stone fraction has a range of about 0.8 – 2 mm, while the sand fraction has a range of about 0.3 – 0.4 mm. The self filler fraction has a range of less than 0.3 mm. It supplied via the pre-separator 22 to the main separator 23, as indicated by the arrow 36, and at that location is separated. And supplied to the filler return screw 27 of the conveyor means 8 as indicated by the arrow 38. The self filler fractions from all the preparing means 2 are combined and are transported by the conveyor means 8 into the silo 9 (see FIG. 1).

As explained all grain size ranges are treated separately. Thus, in each heating silo 3 an exactly controllable stone and sand fraction without self filler is obtained. Of course, it is also possible to use the preparing means 2 within the total apparatus for preparing the filler fraction. Furthermore, it is possible, to locate two dosing means 16 with dosing screws 17 within the hollow range of the inlet screw 19 of a preparing means 2 in order to jointly prepare stone minerals of the same grain size range but of different origin. For example, this can be done with washing sand or pit-sand, where a certain ratio thereof is defined in the prescription.

I claim:

1. A method for manufacturing a coating mass for road constructions, wherein stone minerals of different grain size ranges are dosed, dried, heated, dusted off, and mixed with a binding agent and other flux materials, the stone minerals of the various grain size ranges being separately pre-dosed, dried, and heated, wherein individually absorbed fine material is divided into a sand fraction and into a self filler fraction by means of filtering, wherein the sand fraction is again added to the stone fraction of the respective grain size range, wherein the self filler fractions of all grain size ranges are combined, and wherein the heated stone fractions are weighted and mixed together with the combined self filler fractions and the binding agent in order to form the coating mass.

2. A method as in claim 1 wherein a strange filler fraction is added to the combined self filler fractions.

3. A method as in claim 1 wherein the stone fractions are weighted charge-wise.

4. A method as in claim 1 wherein the sand fractions are added to the stone fractions corresponding to their grain size ranges.

5. A method as in claim 1 wherein the division of the absorbed fine material into the sand and self filler fractions is effected in a plurality of filter stages.

* * * * *